United States Patent [19]

Hallais et al.

[11] 4,038,576

[45] July 26, 1977

[54] PHOTOCATHODE SUPPORT OF CORUNDUM WITH LAYER OF BARIUM BOROALUMINATE OR CALCIUM BOROALUMINATE GLASS

[75] Inventors: Jean Philippe Hallais, Ablon; Michel Jean-Claude Monnier; Jean-Claude Richard, both of Montgeron, all of France

[73] Assignee: U.S. Philips Corporation, New York, N.Y.

[21] Appl. No.: 652,547

[22] Filed: Jan. 26, 1976

[30] Foreign Application Priority Data

Feb. 4, 1975 France ..... 75.03429

[51] Int. Cl.[2] ..... H01J 39/02; H01J 31/38

[52] U.S. Cl. ..... 313/101; 313/385; 313/386

[58] Field of Search ..... 313/94, 101

[56] References Cited

U.S. PATENT DOCUMENTS

| | | | |
|---|---|---|---|
| 3,408,521 | 10/1968 | Dore et al. | 357/16 |
| 3,575,628 | 4/1971 | Word | 313/94 X |
| 3,649,866 | 3/1972 | Salgo | 313/386 X |
| 3,769,536 | 10/1973 | Antypas et al. | 313/94 |

*Primary Examiner*—Robert Segal

*Attorney, Agent, or Firm*—Frank R. Trifari; Carl P. Steinhauser

[57] ABSTRACT

A window for an electron tube formed by a semiconductor device having a support of monocrystalline oxide, by a connection layer formed by a barium- or calcium-boroaluminate, by at least one passivating layer, and by an active layer having a constant composition and formed by a semiconductor material of the p-conductivity type.

3 Claims, 5 Drawing Figures

PHOTOCATHODE SUPPORT OF CORUNDUM WITH LAYER OF BARIUM BOROALUMINATE OR CALCIUM BOROALUMINATE GLASS

The invention relates to an electron tube having a transmission photocathode for the near infrared of the III – V type and p-conductivity, which cathode forms part of a window in said tube. The invention furthermore relates to a method of manufacturing such a photocathode. cathode.

Tubes as described above are used inter alia in the form of night glasses and radiation detectors.

U.S. Pat. No. 3,769,536 discloses a photoelectron multiplier having a photocathode which is connected directly to the glass wall of the tube by a thermal treatment, possibly with a passivating intermediate layer of silicon dioxide. One of the drawbacks of glass as a substrate for a III – V photocathode is that as a result of the high temperature which is necessary to produce the connection, difficulties with the matching of the thermal expansion occur in connection with the transition point of the glass. It is the object of the invention to provide a different construction which has certain advantages.

According to the invention, in an electron tube having a photocathode for the near infra-red of the III – V and p-conductivity, which cathode forms part of a window in said tube, the window consists of an oxidic monocrystalline body on which the photocathode is adhered by means of a glass which is permeable in the wavelength range in question and is chemically resistant. Such a structure forms a rigid mechanical assembly while a correct matching of the coefficients of expansion can be obtained. According to the invention, the oxidic monocrystalline body preferably consists of corundum which is connected to the photocathode by means of a "short" glass. For the short glasses are to be considered calcium boroaluminate glasses having a composition of 15 – 35% CaO, 45 –70% $B_2O_3$ and 10 – 20% $Al_2O_3$ or barium boroaluminate glasses having a compositon of 10 – 35% BaO, 45 – 70% $B_2O_3$ and 10 – 20% $Al_2O_3$, the thickness of the glass being from 50 to 500 $\mu$m. According to the invention the window has a flat metal edge or a cylindrical ring which contacts conductors which extend up to the connection glass. The metal edge may consist of nickel, gold, titanium or alloys thereof.

The passivating layer may have two functions, first of all a chemical function so as to prevent attack of the cathode by the glass and in that case the layer may consist of silicon dioxide, or of an oxide of the semi-conductor of the cathode itself. The passivating layer may also be required from an electronic point of view, namely to prevent recombination of electrons at the interface of cathode and support. In this case the intermediate layer is chosen to be a semiconductor of the p-conductivity type having a large band width (1.3–2.0 eV).

By the choice of the window material a large thermal conductivity is obtained which is favourable upon incorporating the window in the tube and the thermal treatments thereof. In general the connection between the cathode and the window can be produced at temperatures lower than in the known construction.

A favourable method of manufacturing the photocathode and connecting same to the window according to the invention is carried out as follows. First of all, a layer of a binary or pseudo-binary semiconductor, both of the n-conductivity type and having a gradually varying composition is grown on a semiconductor support. A layer of the relevant material but of a constant composition is then grown as an active photocathode layer having p-conductivity type. One or more passivating layers (chemical and/or electronic passivating layers) are provided on said active layer. On a monocrystalline body of oxidic composition is provided a layer of a short glass having electric contacts to the exterior, surrounded by a flat or cylindrical metal ring. The passivating layer and the "short" glass are then laid against each other and the two parts are then connected together at elevated temperature and under a certain pressure. The n-conductive layers are then removed by a selective etching treatment.

The pressure used is 1–5 kg/cm$^2$, the temperatures are 620°–650° C and the treatment is preferably carried out in a neutral atmosphere.

The invention will be described in greater detail with reference to the drawing in which.

For clarity, the same reference numerals are used for the layers in the various Figures, while the respective thicknesses of the said layers are not drawn to the same scale.

For the description a window was chosen for an electron tube the active layer of which is formed by a ternary material (Ga, In) As.

Figure 1:
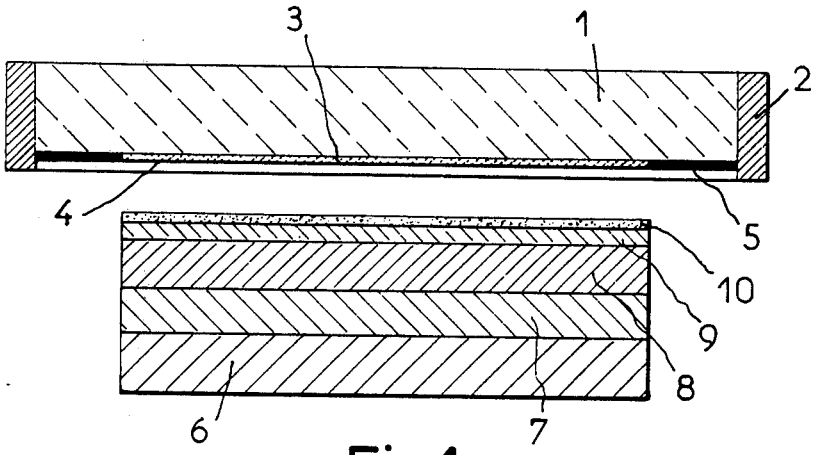
FIGS. 1, 2 and 3 show a window according to the invention in various stages of manufacture.

FIG. 1 shows the monocrystalline support 1 of corundum surrounded by a metal ring 2 which is to ensure the mechanical connection and the sealing of the window; the front face 3 of the support 1 is covered with a layer 4 of glass of the short type in which the electric platinum contacts 5 are sealed. A layer 7 having a regularly varying composition and being formed by the ternary material (Ga, In)As is provided on the gallium arsenide layer 6 by epitaxy from the gaseous phase. An active layer 8 of (Ga, In)As having a constant composition is provided on the said layer 7 via a subsequent epitaxy treatment from the gaseous phase.

The layer 8 is covered with a first passivating layer 9 of the type having electronic passivation and formed by a semiconductor material of p-conductivity type and a large band distance (Ga, In)P the indium content of which is such that the coefficient of expansion corresponds to that of the (Ga, In)As of constant composition, and having a thickness between 10 $\mu$ and 20 $\mu$.

A second passivating layer 10 of the type having chemical passivation is formed by silicon oxide having a thickness between 500 A and 2000 A.

Said layers 9 and 10 are formed according to known methods: for the layer 9 having electronic passivation this is done via adapted epitaxy, whilst for the layer 10 having chemical passivation the formation occurs by pyrolysis of silane oxide.

Figure 2:
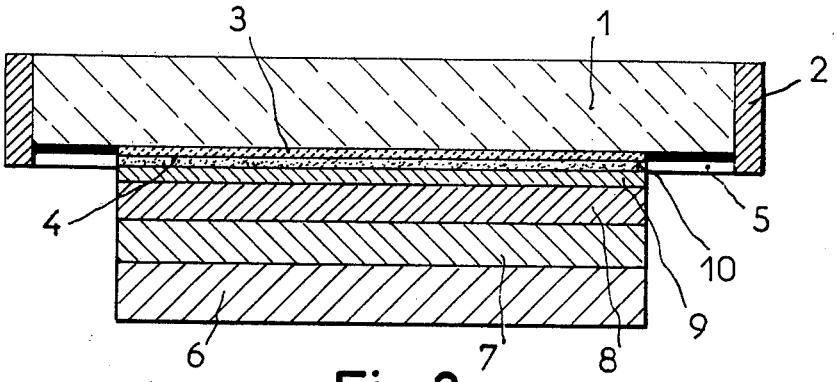

The same elements occur in FIG. 2 in which the glass layer 4 is in contact with the passivating layer 10.

In this stage of the manufacture the assembly is subjected in a neutral atmosphere to a pressure between 1 kg/cm$^2$ and 5 kg/cm$^2$ and to a temperature between 620° and 650° C.

Figure 3:
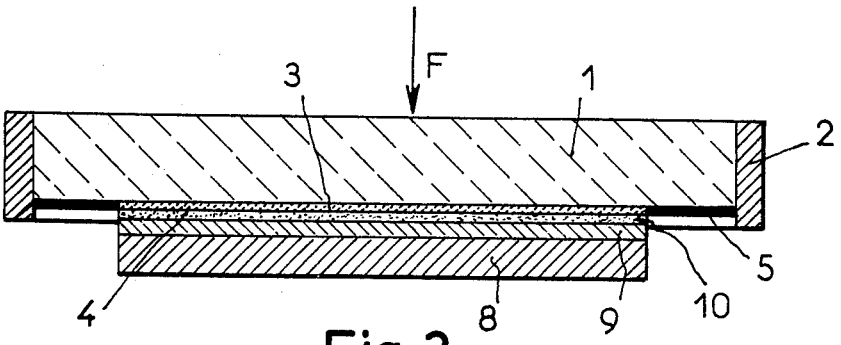

After the thus treated assembly is rigidly connected under the influence of temperature and pressure, the selective etching treatment of the substrate 6 and of the zone 7 having a regularly varying composition is carried out by suitable successively used chemical and electrochemical baths. In this manner a window is obtained which corresponds to the invention and which is shown in FIG. 3 and is destined for an electron tube.

Figure 4:
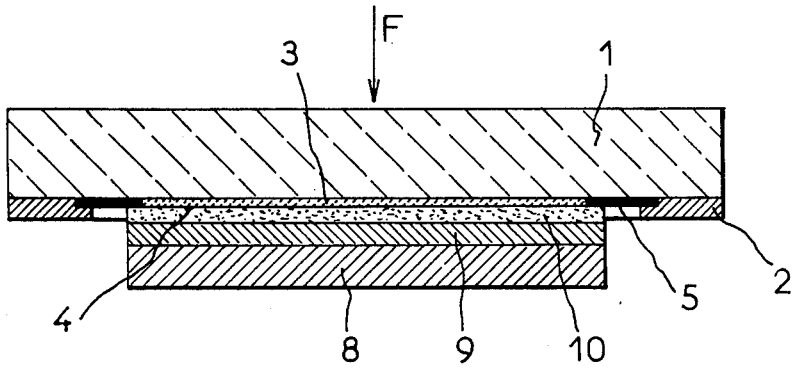
FIGS. 4 and 5 show special embodiments of a window according to the invention.

FIG. 4 shows a modified embodiment of a window according to the invention. According to this modifiec embodiment the metal ring 2 which is destined to ensure the mechanical connection and the sealing, is formed by successive metallizations of nickel and gold obtained via cathode sputtering.

Figure 5:
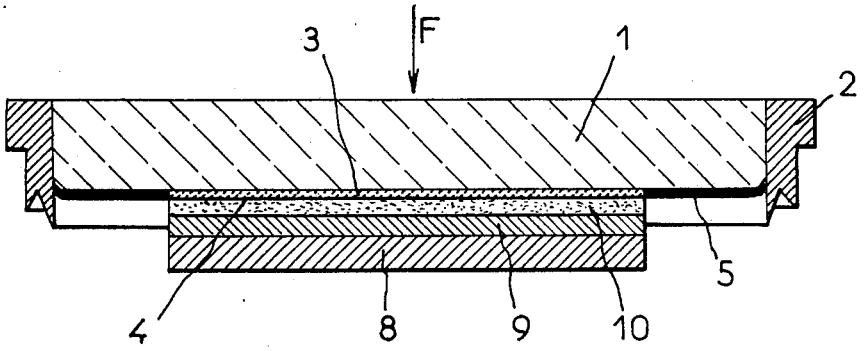

FIG. 5 finally shows another modified embodiment of the window according to the invention. According to said modified embodiment the metal ring 2 is manufactured via hard soldering of a ring provided with a knife edge rim.

In this case the window according to the invention is formed only by a monocrystalline support 1 which is surrounded by the metal ring 2 and which on its front face 3 supports the connection glass 4. This glass 4 very rigidly welds the support 1 to the first passivating layer 10 which covers the second passivating layer 9, said layer 9 covering the active layer 8. The electric contacts 5 are present between the connection glass and the cathode and are connected to the metal ring 2.

The window (3–8) can be accommodated in an electron tube by soldering the ring 2. The cathode may be subjected to the known activation processes after which caesium and oxygen are adhered to the surface.

What is claimed is:

1. In an electron tube having a photocathode for the near infra-red of the III–V type of the p-conductivity type, a window consisting of an oxidic monocrystalline body of corundum on which the photocathode is secured by a glass which is pervious in the relevant wavelength range and is chemically resistnat, said glass being selected from barium boroaluminate and calcium boroaluminate having the composition 15–35% CaO, or BaO, 45–70% $B_2O_3$ and 10–20% $Al_2O_3$.

2. An electron tube as claimed in claim 1, wherein the window has a flat or cylindrical metal edge from which electric contacts extend up to the connection glass.

3. An electron tube as claimed in which the photocathode is (Ga, In) As.

* * * * *